US005835611A

United States Patent [19]

Kaiser et al.

[11] Patent Number: 5,835,611

[45] Date of Patent: Nov. 10, 1998

[54] METHOD FOR ADAPTING THE TRANSMISSION CHARACTERISTIC OF A HEARING AID TO THE HEARING IMPAIRMENT OF THE WEARER

[75] Inventors: Eduard Kaiser, Forchheim; Roland Weidner, Zapfendorf; Manfred Kachler, Nuernberg; Jörg Haubold, Dortmund, all of Germany

[73] Assignee: Siemens Audiologische Technik GmbH, Erlangen, Germany

[21] Appl. No.: 867,522

[22] Filed: Jun. 2, 1997

Related U.S. Application Data

[63] Continuation of Ser. No. 399,643, Mar. 7, 1995, abandoned.

[30] Foreign Application Priority Data

May 25, 1994 [DE] Germany ..... 44 182 03.1

[51] Int. Cl.[6] ..... H04R 25/00

[52] U.S. Cl. ..... 381/321; 381/314

[58] Field of Search ..... 381/312, 314, 381/315, 320, 321, 60, 58, 59; 73/585; 600/559

[56] References Cited

U.S. PATENT DOCUMENTS 2,394,569 2/1946 Strommen .
4,577,641 3/1986 Hochmair et al. .
4,953,112 8/1990 Widin et al. .
5,144,674 9/1992 Meyer et al. .
5,226,086 7/1993 Platt .
5,341,433 8/1994 Meyer et al. .

FOREIGN PATENT DOCUMENTS 0 537 026 4/1993 European Pat. Off. .
OS 42 21 300 1/1994 Germany .

*Primary Examiner*—Curtis A. Kuntz
*Assistant Examiner*—Ping W. Lee
*Attorney, Agent, or Firm*—Hill & Simpson

[57] ABSTRACT

In a method for the adaptation of the transmission characteristic of a hearing aid to the hearing aid impairment of a hearing aid wearer using a personal computer having a pointer device such as a mouse, the acoustician selects segments of the graphic presentation of the hearing aid parameters with the mouse, modifies the graphics point-by-point or segment-by-segment by displacement of the mouse and thereby correspondingly co-modifies appertaining, displayable parameters. The hearing aid can be adapted to reach a target characteristic by means of one adaptation procedure, followed if necessary by further analogous fine adaptation procedures.

9 Claims, 3 Drawing Sheets

METHOD FOR ADAPTING THE TRANSMISSION CHARACTERISTIC OF A HEARING AID TO THE HEARING IMPAIRMENT OF THE WEARER

RELATED APPLICATION

The present application is a continuation of application Ser. No. 08/399,643, filed Mar. 7, 1995, and now abandoned.

BACKGROUND OF THE INVENTION

1. Field of the Invention

The present invention is directed to a method for the adaptation of the transmission characteristic of a hearing aid to the hearing impairment of the wearer using a data processing system having a display, whereby graphics can be displayed at the display.

2. Description of the Prior Art

The adaptation of hearing aids to the respective hearing impairment of the subject confronts the hearing aid acoustician with a large number of different programming possibilities. These arise due to the various hearing aid manufacturers, the number of available apparatus types and the many hearing aid parameters that can be varied by control elements or by programming such as frequency response (for example, edge shift/edge steepness in the bass and treble range), gain, cut-off point of the AGC, peak clipping, etc. The number of programming possibilities has become so large that it can no longer be justified even in terms of time expenditure to run through all these possibilities in order to arrive at an optimum adaptation. Moreover, such a tiresome adaptation procedure cannot be imposed on the subject. Automated adaptation methods have therefore been proposed, as in U.S. Pat. No. 4,953,112. Nonetheless, the hearing aid acoustician continues to be confronted with a significant number of different setting possibilities, given programmable hearing aids, that influence the acoustic behavior of the hearing aid.

European application 0 537 026 discloses a hand-held programmer for programming programmable hearing aids. This programmer is equipped with a microcontroller and has a display, a keyboard as well as a communication interface to the hearing aid programming unit. This known programmer is connected to the hearing aid via a hardwired connection and displays the setting of the hearing aid control elements at the display. For programming, the control displays can be modified at the display via the keyboard and the setting of the hearing aid control elements corresponding to a predetermined control display can be transferred to the hearing aid. The modified setting of the hearing aid control elements can be read from the display in the form of a bar diagram.

German OS 38 34 962 discloses a programming device having a display on which the parameter values can be displayed. The setting to be undertaken with a keyboard can be facilitated by a schematic imaging of the transmission characteristic of the hearing aid, whereby a setting of the hearing aid controls is again displayed at the display and this display can be modified with the keyboard, and the setting of the hearing aid control elements modified at the display can be transferred by the programming process to the actual hearing aid. The modification of the control adjustment via the keyboard involves a modification of the imaging of the transmission characteristic.

Given a data input of the type disclosed in German OS 42 21 300, a touch screen control panel customized for use by an acoustician is provided instead of a keyboard. The matrix field with its sensors thereby makes it possible for the audiologist to place graphic sheets having audiogram curves of the hearing-impaired person thereon, these sheets then being secured to the control panel with fixing elements. Thereafter, the audiologist can trace the audiogram curve of the hearing-impaired person with a stylet, whereby the data supplied by the sensors of the matrix field are converted with a computer into a target gain curve and can be supplied to the hearing aid.

SUMMARY OF THE INVENTION

The present invention proceeds from the recognition that it is extremely training-intensive to allocate the designation of the various controls to a specific acoustic modification of the hearing aid, as well as the fact that the hearing aid acoustician is familiar with the graphic presentation of the various hearing aid parameters (for example, frequency characteristic, separating frequency, single-channel or multi-channel nature, AGC-I, AGC-O, etc.). Taking these facts into consideration, it is an object of the invention to provide an adaptation method for hearing aids, suitable for programmable hearing aids as well as for conventional hearing aids having mechanical control elements, that provides the hearing aid acoustician with the possibility of modifying the properties of the hearing aid to adapt the hearing aid to the respective hearing impairment of the subject in the simplest way using his or her expert knowledge gained from experience.

In a method of the type described above wherein a graphics display is presented, this object is inventively achieved in that segments of the graphics can be directly supplied to the hearing aid to vary the displayed transmission characteristic of the hearing aid in the direction of a desired target characteristic by means of a freely positional pointer device. The transmission characteristic variable in this way can be directly graphically presented at the display, and the relevant, modified parameter can be displayed at the display directly at a pointer symbol of the pointer device during the manipulation for modifying the transmission characteristic. This manipulation can be implemented at various locations of the graphics and as often as desired, and the desired target characteristic is directly transferred onto the hearing aid after it has been reached.

According to the invention, the acoustician selects those locations in the graphic presentation of a transmission characteristic that he or she wishes to modify at the display of a PC type computer using the pointer device, for example by clicking a mouse of the computer, and displaces the graphics into the desired direction by moving the mouse. The result is that the actual electrical parameter in the hearing aid is directly correspondingly co-altered with the graphics modification, whereby the arithmetic unit supplies the modified graphics pertaining to the formation and presentation of the modified transmission characteristic to the data processing unit of the hearing aid. The advantage of this approach is that the values modifiable with the pointer device at the picture screen of the PC can be directly transferred from the picture screen into the hearing aid given programmable hearing aids. In conventional hearing aids having mechanical (manual) controls, a transmission characteristic corresponding to the graphics of the picture screen can be set at the hearing aid using these manual controls.

If a test with the hearing aid set to the target characteristic calculated in an initial adaptation procedure does not yet supply a satisfactory result, then the acoustician can undertake further manipulations for fine adaptation. For the purpose of a fine adaptation, the target characteristic calculated in the preceding adaptation procedure can be displayed at the picture screen. The acoustician then undertakes further manipulations (shifts) at the graphics to be modified with the pointer device. An altered target characteristic arises therefrom, this being again directly transferrable to the hearing aid. This altered hearing aid setting can then be tested with the test subject.

For facilitating the adaptation procedure for the acoustician for manually settable hearing aids the relevant, modified parameters in the direct manipulation of the graphics can be displayed as an image of a slide switch, a rotary control (thumbwheel) or the like, whereby the display is dynamically linked to the necessary mechanical manipulation.

In addition to the variable parameters, those parameters specifically associated with the hearing aid (i.e., component characteristics) can also be presented on the picture screen of the PC, but these remain unmodified during the adaptation event because, for example, they are defined by the manufacturer as a consequence of the type of hearing aid.

A further significant factor facilitating the adaptation procedure for the acoustician is that the pointer symbol is allocated to the pointer of the pointer device. This pointer symbol informs the acoustician of that control designation or those hearing aid parameters that he or she intends to modify (an in fact does modify at the moment) using the pointer of the pointer device. Simultaneously with the modification of the graphic presentation at the display which reproduces the transmission characteristic of the hearing aid, images of sliding switches that can be mixed-in at the picture screen are likewise variable in terms of their settings by the pointer device.

The manipulation/modification of the graphics at the picture screen can be initiated by an actuation means of the pointer device, for example by a click with the mouse key, when the location of the graphics provided for the modification has been touched or selected with the pointer, and the acoustician displaces the graphics in the desired direction with the pointer. This results in the fact that the appertaining parameter, which is in turn displayed for the acoustician, is correspondingly co-modified. The data processing system thereby makes it possible to again graphically display a modified transmission characteristic for the acoustician immediately after the intervention.

DESCRIPTION OF THE PREFERRED EMBODIMENTS

Figure 1:
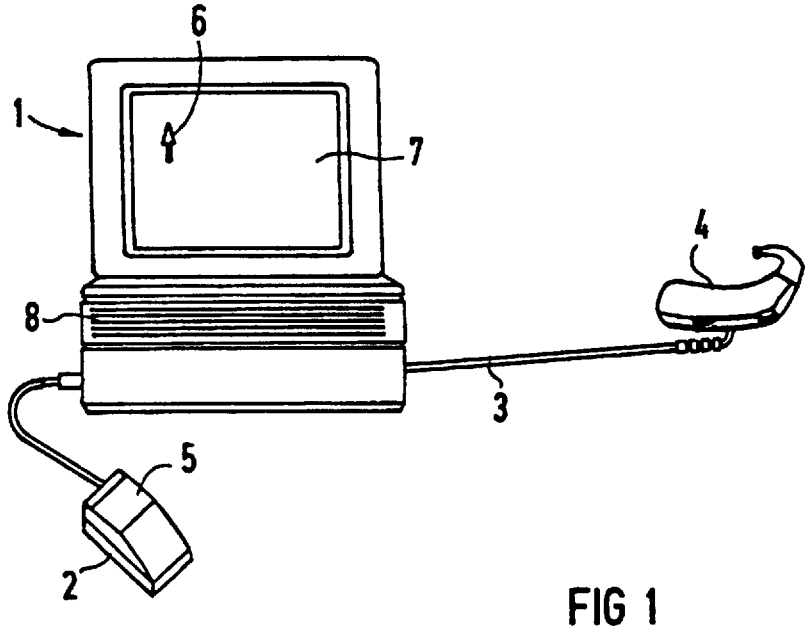
FIG. 1 illustrates the basic configuration of a programmable hearing aid, a personal computer and a pointer device for practicing the inventive method for adapting the transmission characteristic of the hearing aid.

The basic components of a system which enables the method of the invention to be practiced are shown in FIG. 1. These components include a programming device, such as a personal computer 1, which is equipped with a pointer device 2. In the embodiment shown in FIG. 1, the pointer device 2 is in the form of a mouse, however, it will be understood that the method of the invention can be practiced with any type of pointer device, such as a roller ball on the personal computer keyboard, a light pen, a touch screen, a touch-sensitive pad, etc. The pointer device 2 has a switch 5, which in the embodiment of FIG. 1 is a depressible key or push button on the mouse.

The personal computer 1 is connected to a hearing aid 4, whose transmission characteristics are to be adapted, by means of a hardwired connection 3. The transmission can alternatively take place wirelessly, via a standard telemetry system.

The personal computer 1 has a display screen 7, on which a pointer 6, in this case a curser, is movable by operation of the pointer device 2. The personal computer 1 also includes a data processing system 8.

Figure 2:
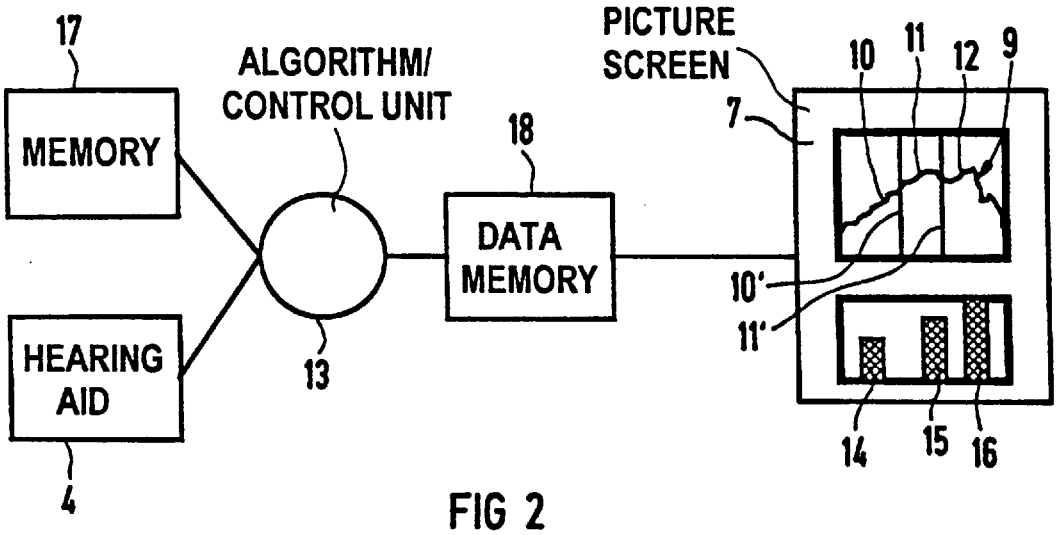
FIG. 2 is a simplified block diagram of components for practicing the method of the invention.

FIG. 2 shows a simplified block circuit diagram of a method of the invention for graphic manipulation or modification of hearing aid control, for example programmable hearing aids. As already mentioned, the hearing aid acoustician is confronted with a multitude of different setting possibilities given programmable hearing aids, these influencing the acoustic behavior of the hearing aid. It often requires intensive training to allocate the designation of a control to an acoustic modification of the hearing aid. The invention makes it possible for the acoustician to modify the properties of the hearing aid in the simplest way by selecting a graphics 9 shown on the display 7 of the PC 1 that corresponds to a specific transmission characteristic of the hearing aid 4 at locations, for example 10, 11 or 12 that he or she intends to modify with the pointer device 2. The acoustician is familiar with the audiogram of the test subject and can already decide based on his or her experience what modifications must be undertaken in the transmission characteristic of a hearing aid 4 that, for example, was set at the factory, in order to adapt the hearing aid 4 to the hearing impairment of the test subject, at least in terms of a first approximation. The acoustician clicks a selected location 10 or, respectively, 11 or 12 of the graphics 9 with the pointer 6 of the pointer device 2 and with the pointer key 5 and shifts the corresponding point or segment of the graphics in the desired direction. This results in an appertaining transmission parameter, for example the amplification (volume), automatic gain control (AGC), the output acoustic pressure level (PC), the treble and base reduction, the setting of the separating frequency given multi-channel apparatus and the like, being correspondingly co-modified and the co-modified value causes the display of the appertaining transmission parameter to be altered (updated) to display the new value. On the basis of rules stored in an algorithm/control unit 13, the data processing system 8 calculates a modified transmission characteristic and displays this at the picture screen 7 as a modified graphics. Moreover, the AGC thresholds 14, 15 and 16, for example, can be portrayed in the form of a bar graph in the case of multi-channel apparatus.

According to the block circuit diagram of FIG. 2, the basic values of a hearing aid setting are stored in a memory 17, these representing the starting values for all further calculations. The algorithm/control unit 13 calculates the acoustic behavior of the current setting using the data of the memory 17 and on the basis of the current setting of the hearing aid 4, and stores the result in a data memory 18. The content of the data memory 18 is graphically displayed at the display 7. In the example, the frequency characteristic and the AGC thresholds of a three-channel hearing aid are graphically shown. Each control of the hearing aid is allocated to a graphics area at the display. In the example, eight different programmable controls 10, 10', 11, 11', 12, 14, 15 and 16 are present. The types of control and the appertaining graphics area can likewise be stored in the data memory 18.

Figure 3:
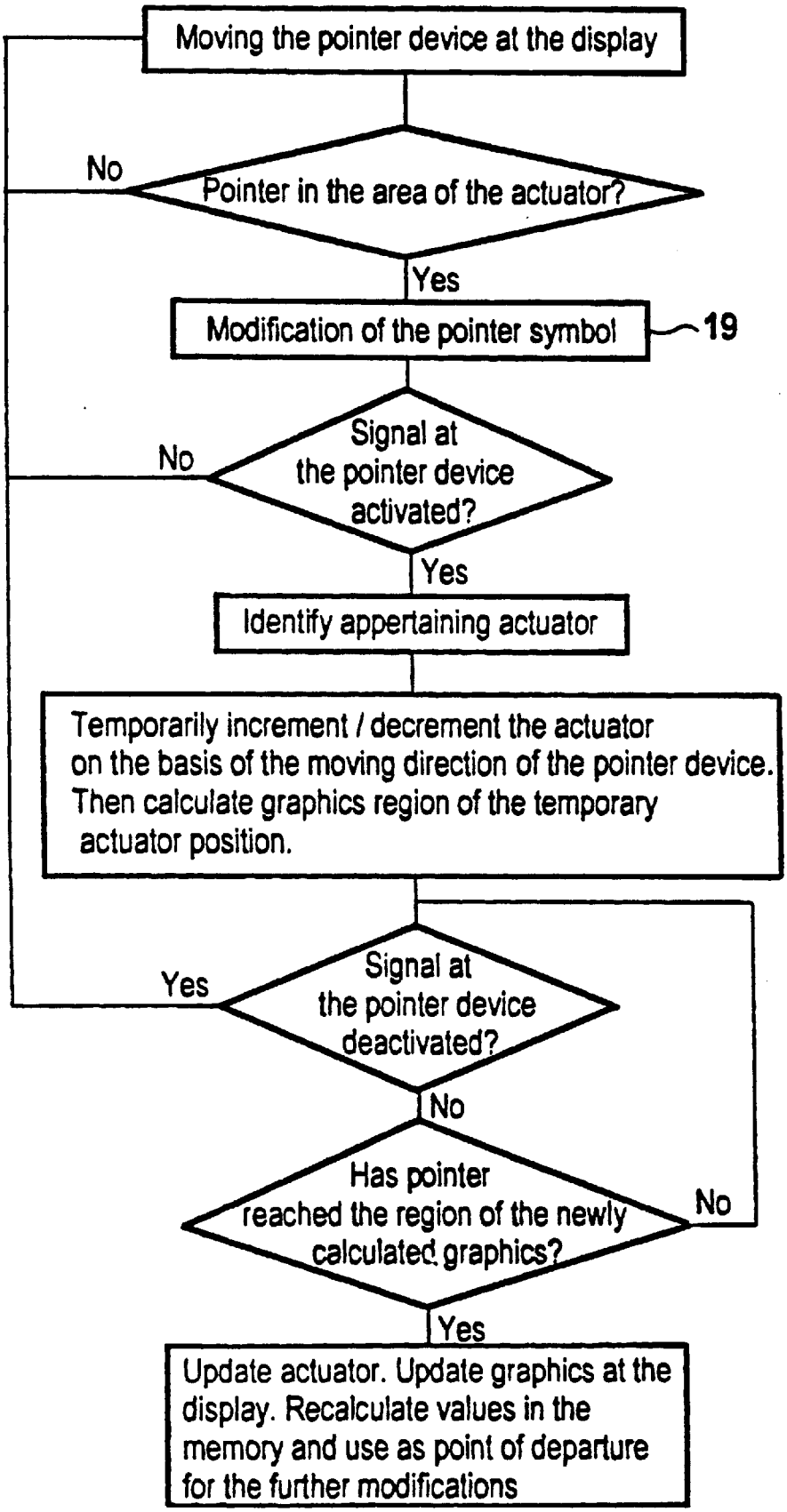
FIG. 3 is a flowchart setting forth further details of the steps of the inventive method.

The method of the invention for the adaptation of the transmission characteristic of a hearing aid is summarized again in individual steps in a flowchart according to FIG. 3.

At the beginning of the adaptation procedure, the picture screen 7 of the PC supplies one or more graphic curves that are based on characteristics specifically associated with the hearing aid. The acoustician has calculated an audiogram of the test subject that corresponds to the hearing impairment of the test subject. On the basis of this audiogram and on the basis of the hearing aid characteristics (graphics relating to the transmission characteristics of the respective hearing aid), the acoustician, as a trained professional, can already estimate what possible modifications are to be undertaken in the basic settings of the hearing aid means that has been selected. The invention now permits the acoustician to accomplish the adaptation of the hearing aid simply and quickly.

The acoustician makes use of the pointer device 2 and moves the pointer 6 thereof into the proximity of the point or segment of graphics 9 of the basic setting that is to be modified. When the pointer key 5 is clicked and the graphics is shifted in the desired direction, a pointer symbol 19 allocated to the pointer 6 automatically informs the acoustician of what hearing aid parameter that he or she has just manipulated or modified.

On the basis of the manipulation that has been undertaken, the data processing system alters the hearing aid transmission characteristic and displays an updated graphics at the picture screen 7. When the acoustician believes, for example even after a test of the hearing aid, that further corrections of the transmission characteristic must be made until the desired target characteristic has been set, then a plurality of fine corrections can be undertaken in the described way. When the suitable target characteristic is reached, then the acoustician, given a programmable hearing aid, can transfer the correct parameters for the desired transmission characteristic into the memory of the hearing aid by a hardwired connection or by remote control as well. Given conventional hearing aids having mechanical controls, the acoustician undertakes an adjustment of these controls in the way the calculated graphics on the picture screen prescribes.

Figure 4:
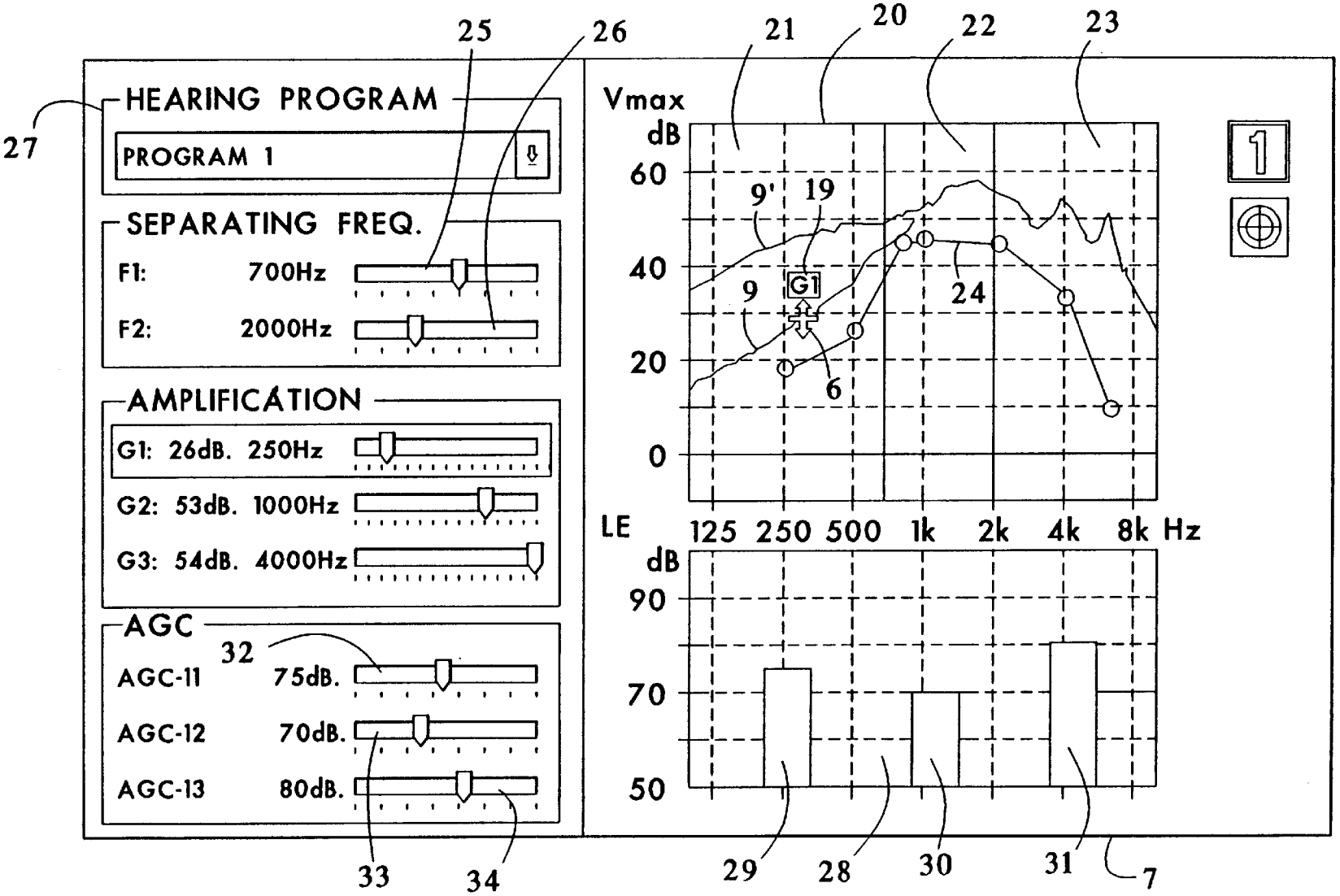
FIG. 4 is an illustration of an exemplary display for use in practicing the method of the invention.

The frequency bands 21, 22 and 23 of a three-channel hearing aid and graphics 9, 9' as well as 24 are shown at the display 7 of FIG. 4 in a first image area 20. The amplification Vmax is recited in Db in the vertical axis and the frequency range is recited in Hz in the horizontal axis. In the selected Program One, for example a hearing aid program for a normal ambient/auditory situation, the separating frequencies between the channels are set at F1=700 Hz and F2=2, 000 Hz, as the slide controls 25 and 26 in the image section 27 also show.

In the exemplary embodiment, the acoustician undertakes a modification of the graphics 9 in the direction toward the graphics 9' with the pointer 6 of the pointer device 2. The hearing aid adjustment parameter selected for modification—the gain control G1—is thereby indicated to the acoustician by the pointer symbol 19 having the designation G1. The pointer symbol is preferably modified such that the possible directions of the motion can also be recognized in addition to the type of activated control. Further, hearing aid adjustment parameters that can be modified according to the exemplary embodiment and that can be recited in the pointer symbol 19 would be the designations G2, G3, AGC1-AGC3 or F1, F2.

According to the exemplary embodiment, further, three hearing aid adjustment parameters 29, 30 and 31 are shown in bar graph form in the image area 28. These adjustment parameters respectively allocated to the automatic gain control thresholds AGC1, AGC2 and AGC3 can likewise be directly modified with the pointer device 2. Analogously, these AGC adjustment values can likewise be read at slide controls 32–34.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for adapting the transmission characteristic of a hearing aid to a hearing impairment of a wearer of the hearing aid, comprising the steps of:

(a) providing a hearing aid having an adjustable, current transmission characteristic, said hearing aid having a plurality of variable operating parameters individually settable at respective values which determine said transmission characteristic;

(b) establishing a communication link between said hearing aid and a computer having a display screen and a freely movable pointer device manipulable to move a pointer on said display screen in arbitrary directions;

(c) presenting a graphics display on said display screen comprising a plurality of graphics segments respectively identifying said variable operating parameters;

(d) simultaneously presenting an additional graphics display on said display screen comprising said current transmission characteristic, to be adjusted, of said hearing aid;

(e) identifying a target transmission characteristic to which said current transmission characteristic is to be adjusted;

(f) manipulating said pointer device to position said pointer on said display screen on said current transmission characteristic and moving said pointer in a direction necessary to adjust at least a portion of said current transmission characteristic into conformity with said target transmission characteristic, the adjustment of said at least a portion of said current transmission characteristic requiring modification of one of said parameters displayed in one of said graphics segments;

(g) simultaneously with the manipulation of said pointer device, modifying said one of said parameters in said computer to a modified value as required by the adjustment of said current transmission characteristic, and altering the graphics segment for said one of said parameters to display said modified value for that parameter;

(h) repeating steps (f) and (g) until said current transmission characteristic conforms to said target transmission characteristic; and (i) transmitting each modified value of the respective operating parameters to said hearing aid via said communication link to set said variable operating parameters in said hearing aid respectively at said modified values.

2. A method as claimed in claim 1 comprising the additional steps of:

presenting a third graphics display on said display screen comprising said target transmission characteristic; and repeating steps (f) and (g) multiple times, and with each repetition of step (f), manipulating said pointer device to position said pointer increasingly closer to the displayed target transmission characteristic.

3. A method as claimed in claim 1 wherein step (a) is further defined by providing said hearing aid with mechanically manipulable exterior controls for respectively setting said operating parameters, and wherein said method comprises the additional step of:

in the display of the graphics segment for each operating parameter, displaying a pictorial representation of the mechanically manipulable control for setting that parameter together with displaying numerical representations of said modified values, and changing said pictorial representation of the mechanically manipulable control dependent on the modified value of the operating parameter associated therewith.

4. A method as claimed in claim 3 wherein at least one of said mechanically manipulable controls comprises a sliding switch, and wherein said pictorial representation comprises a pictorial representation of said sliding switch.

5. A method as claimed in claim 3 wherein at least one of said mechanically manipulable controls comprises a thumbwheel and wherein said pictorial representation comprises a pictorial representation of said thumbwheel.

6. A method as claimed in claim 1 wherein step (a) is further defined by providing said hearing aid with a plurality of further, non-variable operating parameters, and comprising the additional step of displaying said non-variable operating parameters on said picture screen in addition to said variable operating parameters.

7. A method as claimed in claim 1 comprising the additional step of displaying said pointer in the form of pointer symbol which identifies a variable operating parameter, of said plurality of variable operating parameters, which is to be modified upon the adjustment of said at least a portion of said current transmission characteristic requiring modification of that operating parameter.

8. A method as claimed in claim 7 comprising the additional step of providing said pointer symbol with an alphanumeric designation of the operating parameter to be modified.

9. A method as claimed in claim 1 comprising the additional steps of:

providing said pointer device with a trigger actuator; and actuating said trigger actuator when said pointer has been manipulated to an intended position as a pre-condition for enabling implementation of step (g).

* * * * *